US005895506A

United States Patent [19]

Cook et al.

[11] Patent Number: 5,895,506

[45] Date of Patent: Apr. 20, 1999

[54] USE OF INFRARED SPECTROSCOPY TO PRODUCE HIGH LUBRICITY, HIGH STABILITY, FISCHER-TROPSCH DIESEL FUELS AND BLEND STOCKS

[76] Inventors: Bruce Randall Cook, 2 Capoolong Creek Rd., Pittstown, N.J. 08867; Paul Joseph Berlowitz, 939 Jamestwon Rd., East Windsor, N.J. 08520; Rebecca Lynn Rucker, 5 Fawn La., Warren, N.J. 07059

[21] Appl. No.: 09/045,578

[22] Filed: Mar. 20, 1998

[51] Int. Cl.[6] ..... C10L 1/08

[52] U.S. Cl. ..... 585/734; 208/27; D44/300; D44/436

[58] Field of Search ..... 585/734

[56] References Cited

U.S. PATENT DOCUMENTS

| | | | |
|---|---|---|---|
| 4,080,397 | 3/1978 | Derr et al. | 208/79 |
| 4,126,643 | 11/1978 | Paxson et al. | 585/417 |
| 4,622,308 | 11/1986 | Koikeda et al. | 502/66 |
| 5,324,335 | 6/1994 | Benham et al. | 44/452 |
| 5,378,348 | 1/1995 | Davis et al. | 208/27 |
| 5,689,031 | 11/1997 | Berlowitz et al. | 585/734 |
| 5,807,413 | 9/1998 | Wittenbrink et al. | 44/451 |
| 5,814,109 | 9/1998 | Cook et al. | 44/300 |

*Primary Examiner*—Ellen M. McAvoy

*Attorney, Agent, or Firm*—Ronald D. Hantman

[57] ABSTRACT

The present invention is a method for controlling a process for producing a distillate fuel heavier than gasoline. The process includes several different fractions, streams, including alcohols, olefins, and acids. At least one of the streams is irradiated with IR radiation, allowing the determination of the concentrations of at least one of alcohols, olefins and acids. The temperature of the separator is then adjusted to change the concentrations to pre-determined values.

9 Claims, 5 Drawing Sheets

USE OF INFRARED SPECTROSCOPY TO PRODUCE HIGH LUBRICITY, HIGH STABILITY, FISCHER-TROPSCH DIESEL FUELS AND BLEND STOCKS

BACKGROUND OF THE INVENTION

Typical raw products of high alpha Fischer-Tropsch hydrocarbon synthesis (FT-HCS) are too heavy and too waxy for use as diesel fuel. Therefore, FT-HCS products are universally hydroprocessed to simultaneously reduce the boiling point and improve cold flow properties. In addition hydroprocessing removes any oxygenates and olefins produced during FT-HCS, by converting them to the corresponding paraffins. The removal of olefins and oxygenates is desirable because high olefin contents are directly related to poor oxidative stability and carboxylic acids result in fuel corrosivity. But the complete removal oxygenates including high molecular weight linear primary alcohols is undesirable in that Fischer-Tropsch distillates that retain native long chain primary alcohols exhibit surprisingly high lubricity. Prior art processes maximize the desirable oxygenates, while minimizing undesirable carboxylic acids, and olefins. All of these flow plans require a degree of over hydroprocessing in order to assure product compositions within the desired range. This over processing results in undesirable increases in capital costs and higher operational costs from larger recycle streams and hydrogen consumptions. The ability to control secondary hydroprocessing would therefore allow the continual optimization of the operations, while minimizing both capital and operational expenses. The present invention provides for the use of infra-red spectroscopy to provide real time operational control of a novel flow scheme to produce a high lubricity, high stability Fischer-Tropsch derived diesel fuels and blend stocks. Infrared spectroscopy allows for rapid and reproducible measurement of key olefin, alcohol, and carboxylic acid concentrations in both process streams and final products.

SUMMARY OF THE INVENTION

The present invention is a method to control a process that uses the Fischer-Tropsch (hydrocarbon synthesis) liquids as a component of distillate fuels. The process includes a hydroprocessing step. Hydroprocessing removes any oxygenates and olefins produced during FT-HCS, by converting them to the corresponding paraffins. The removal of olefins and oxygenates is desirable because high olefin contents are directly related to poor oxidative stability and carboxylic acids result in fuel corrosivity. The complete removal of oxygenates including high molecular weight linear primary alcohols is undesirable, in that it has been shown that Fischer-Tropsch distillates that retain native long chain primary alcohols exhibit surprisingly high lubricity. The ability to control secondary hydroprocessing would therefore allow the continual optimization of the operations. Infrared spectroscopy is used to provide real time operational control of the process to produce high lubricity, high stability Fischer-Tropsch derived diesel fuels and blend stocks. Infrared spectroscopy allows for rapid and reproducible measurement of key olefin, alcohol, and carboxylic acid concentrations in both process streams and final products.

In one embodiment, the method includes the steps of separating the product of a Fischer-Tropsch process into a heavier fraction and a lighter fraction. Then the lighter fractions are further separated using a temperature separator into at least two fractions, at least one fraction containing heavy linear primary alcohols and at least one fraction containing lighter linear primary alcohols, olefins, and acids. The alcohol fraction is irradiated with IR radiation and the absorption spectrum produced by the IR radiation is measured.

A number representative of the concentrations of either the alcohols, olefins, or acids in the fraction is determined from the absorption spectrum and then the temperature of the separator is adjusted in response to the concentrations to change the concentrations to pre-determined values. Then at least a portion of the heavier fractions and at least a portion of the olefin and acid fractions are hydroprocessed. Then the recovered hydroprocessed product is blended with at least a portion of the alcohol fraction. The blended hydroprocessed product is fractionated and a distillate product is recovered. In other embodiments, either the blended hydroprocessed product or the distillate product is irradiated in order to obtain an absorption spectrum and, thereby, the concentrations of the alcohols, olefins or acids. Then temperature of the separator may then be adjusted to maintain the concentrations at predetermined values.

DESCRIPTION OF THE PREFERRED EMBODIMENT

Figure 1:
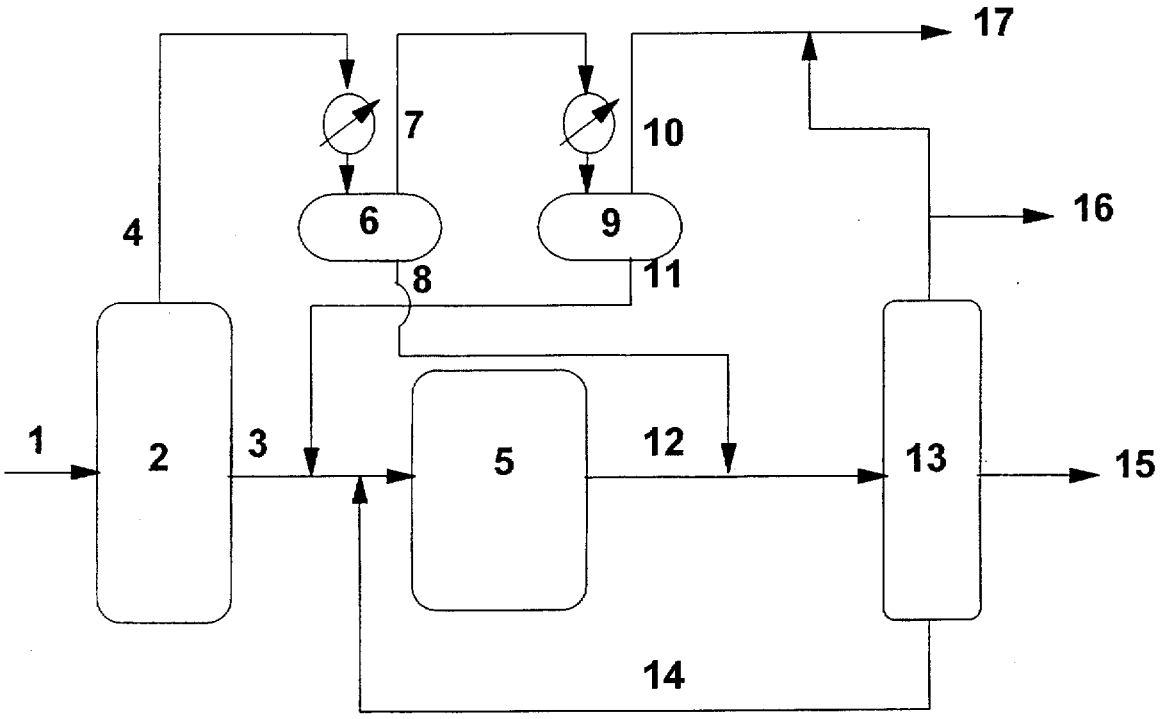
FIG. 1 is a schematic diagram of present process.

The present invention relates to the use of infrared spectroscopy (IR) to optimize and control a process that uses the Fischer-Tropsch (hydrocarbon synthesis) liquids as a component of distillate fuels. Specifically this invention relates to the control and optimization of the hydroprocessing step required for converting hydrocarbon synthesis products into practical distillate fuels. The product of hydrocarbon synthesis is principally composed of linear paraffins, but depending on the catalyst will also contain significant amounts of olefins, linear alcohols, aldehydes and carboxylic acids. Non-shifting catalysts, such as cobalt, produce mostly paraffins, with olefins, and alcohols being the key secondary products. Shifting catalysts, such as iron, produce significantly higher levels of olefins, alcohols, aldehydes, and carboxylic acids. All of these products are produced in what are known as Anderson-Schulz-Flory distributions with a distinctive alpha, which reflects the carbon number distribution. For cobalt based hydrocarbon synthesis catalysts the alpha for paraffin production is significantly greater than the alpha for olefins, alcohols, and carboxylic acid. This means that these minor components will be concentrated in the lighter distillate fraction. The removal of olefins and carboxylic acid is desirable because high olefin content is directly related to poor oxidative stability, and carboxylic acids result in fuel corrosivity. Both of these undesirable components are concentrated in the lower boiling fraction of the hydrocarbon synthesis product. The alcohol products of HCS are found in the full boiling point range of HCS products but are also concentrated in the lower boiling fraction. It has been discovered that the higher molecular weight linear primary alcohols, such as the $C_{12}$+ linear primary alcohols impart superior fuel lubricity properties.

Hydroprocessing effectively converts all olefins and oxygenates to the corresponding paraffins. It is therefore desirable to selectively hydroprocess the products of hydrocarbon synthesis such as to maximize the content of high molecular weight linear primary alcohols, while keeping the olefin and carboxylic acid content below critical levels. This can be accomplished by separating the 700° F.– fraction of HCS into a lighter and heavier fraction, and hydroprocessing only the lighter fraction. The fractionation point for this separation must be high enough that the lighter fraction will contain a sufficient fraction of both olefin and carboxylic acid products that after hydroprocessing the finished fuel will not exhibit undesirable oxidative and corrosive properties. In addition the fractionation point should be low enough so as to preserve the maximum amount of high molecular weight linear primary alcohols. In the absence of on-line analysis, the potential for deleterious effects from olefins and carboxylic acids often requires a higher than required fractionation point as a safety margin, requiring increased capital investment and the potential purchase of lubricity improving agents. The present invention provides for the use of on-line infrared spectroscopy to provide real time operational control of this novel flow scheme to produce a high lubricity, high stability Fischer-Tropsch derived diesel fuel and diesel blend stock. Infrared spectroscopy allows for rapid and reproducible measurement of key olefin, alcohol, and carboxylic concentrations in both process streams and final products.

A schematic diagram of the present invention is shown in FIG. 1. In this plan, carbon monoxide and hydrogen synthesis gas (1) is sent to the HCS unit (2). The HCS reactor configuration is not critical to this invention and could be any of the many HCS reactor configurations well known in the art. These include but are not limited to slurry, fixed, and fluidized bed configurations. Catalysts formulation is also not critical to this invention and could include any of the HCS catalysts well known in the art, although cobalt based catalysts could be particularly preferred for this invention, because they tend to produce a heavier waxy product. The reactor wax (3) is sent to the hydroisomerization—H/I unit (5), where the wax undergoes H/I and mild hydrocracking—H/C, such that a distillate product is produced. The split between reactor wax (3) and the raw F-T hot and cold separator liquids (11) and (8) can be adjusted in temperature by means of this invention, typically the reactor wax 625° F– to 725° F–. Similarly, the final product fractionation points can be adjusted by means of this invention to produce fuels which conform to desired specifications. Once again the reactor configuration for the H/I unit is not critical to this invention, and may be chosen from those well known in the art for heavy paraffin H/I and/or mild H/C. Typical configurations include but are not limited to fixed and slurry bed operation. This invention should be particularly advantageous to fixed bed operation, because of the known beneficial effect of added HCS oxygenates. The H/I catalysts can be chosen from the wide range of materials well known in the art, including Group VIII metal and metal oxide, and metal sulfide promoted silica-aluminas, fluorided aluminas etc.

The hydroisomerization product is recovered in line 12 into which the 500° F.– 700° F. stream of line 8 is blended. The blended stream is fractionated in tower 13, from which 700° F.+ is, optionally, recycled in line 14 back to line 3, $C_5$– is recovered in line 16, and may be mixed with light gases from the cold separator 9 in line 10 to form stream 17. A clean distillate boiling in the range of 250–700° .F is recovered in line 15. This distillate has unique properties and may be used as a diesel fuel or as a blending component for diesel fuel.

The HCS overhead (typically 600 to 700° F.– fraction)(4) is flashed such that the lighter portion 11 contains most of the undesirable olefins and carboxylic acids, as well as undesirable low molecular weight linear primary alcohols. Stream 11 is then sent to HI where these undesirable components are hydroprocessed to form their corresponding paraffins. The heavier portion, stream (8), which contains the heavier linear primary alcohols, is sent directly to distillation (13) and product blending. Fractions are collected in the hot (6) and cold (9) separators. The fractionation point is determined by the temperature of the hot (6) separator. By the application of this invention the infrared spectrum of the hot separator liquid effluent, stream 8, is continuously monitored. The temperature of the hot separator (6) is adjusted upward until the absorbance at 1642 cm–1 and 1713 $cm^{-1}$ is maintained at or below a pre-determined critical value. For a 1 mm optical pathlength and linear baseline used here, that value was determined to be about 0.02 to 0.1 a.u. for both frequencies. A preferred value is about 0.05. This assures that carboxylic acid and olefin concentrations are maintained below critical values, while maximizing the lubricity of the product. Alternative or in addition to monitoring stream 8, either the total blended product stream 12 or the final distilled product stream 15 can be monitored to control the process. Although the specific embodiment shown here calls for making a relatively rough boiling point cut using a flash drum, it is understood that this invention could be applied just as easily and with the same success with sharper cuts using other fractionation equipment, such as a distillation tower. It should also be noted that the presence or absence of the cold separator drum (9) is not key to this invention.

In one embodiment, a small amount of the hot separator liquid effluent, stream 8, is removed from the process by a slipstream, brought to room temperature, and flowed through an infrared spectroscopic flow cell inside a mid-IR FT-IR spectrometer, where a spectrum is acquired. For these measurements, a 1 mm optical pathlength was used, however, other pathlengths could be used with concomitant scaling of the expected absorbance values. For each of the species of interest, infrared bands have been determined for which the height of the band is related to the concentration. The peak frequencies used for the functional groups are: 3643 $cm^{-1}$ for alcohol, 1713 $cm^{-1}$ for acids, and 1642 $cm^{-1}$ for olefins. For each functional group, a linear baseline is drawn: 3665–3615 $cm^{-1}$ for alcohols, 1755–1685 $cm^{-1}$ for acids, and 1658–1630 $cm^{-1}$ for olefins. The height of the peak maximum relative to the baseline is measured. These values are then compared to a predetermined critical value. For the conditions described here, if either the acid band of the olefin band exceeds 0.2 a.u., the temperature of the hot separator (6) is adjusted upward until the value drops below that critical value. Although a specific sampling method is described here, other methods, such as an optical probe inserted in the process or spectral acquisition at elevated temperatures could also be used with suitable calibration. Similarly, other common quantitation techniques, such as quadratic baseline calculations and peak area measurements could also be used.

EXAMPLES

Example 1

A hydroisomerized Fischer-Tropsch diesel fuel, nominally boiling from 250–700° F. was spiked successively with 20, 80, and 2000 ppm hexanoic acid. The mid-infrared spectra were measured using a 1 mm pathlength cell and 2

Figure 2:
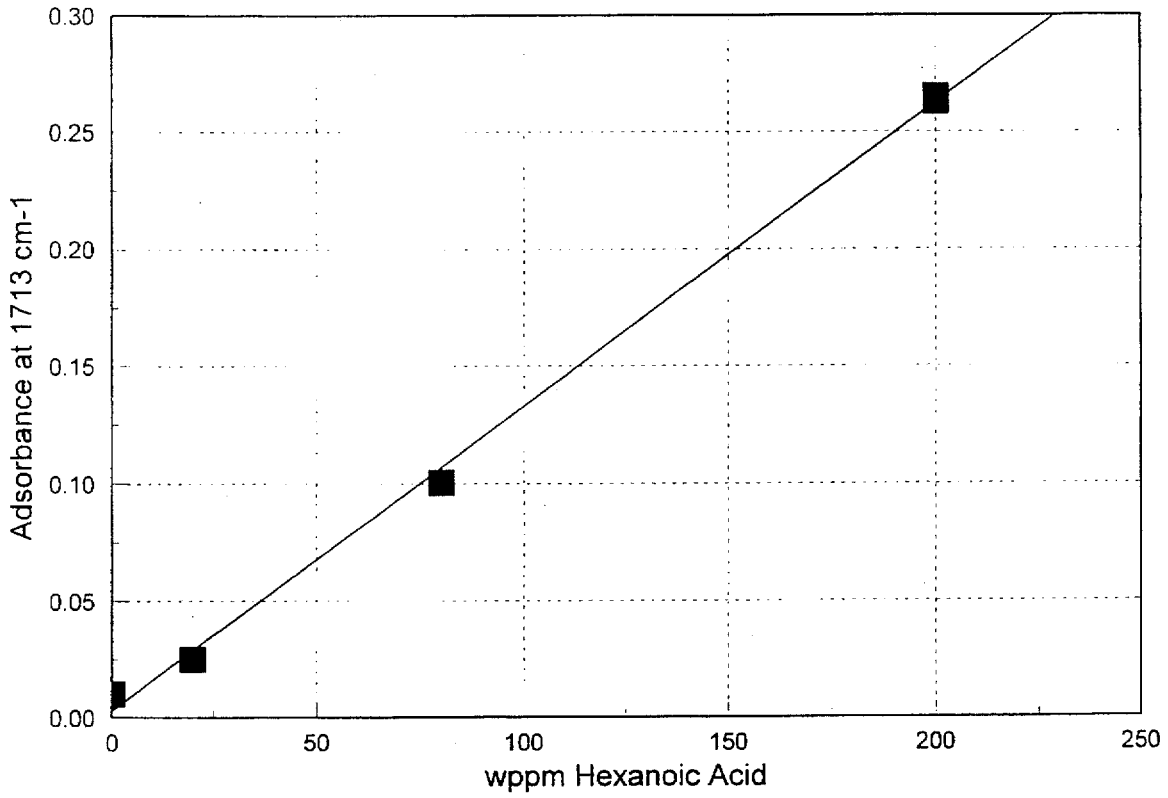
FIG. 2 shows the the linear correlation between hexanoic acid concentration and the absorbance at 1713 $cm^{-1}$.

$cm^{-1}$ spectral resolution. A linear baseline correction, drawn between 1755 $cm^{-1}$ and 1685 $cm^{-1}$, was used. (Other cell pathlengths, spectral resolutions and baseline corrections could be used.) The peak absorbance was taken to be the highest absorbance value in the 1711–1715 $cm^{-1}$ range. The absorbance value reported was determined by measuring the absorbance at the peak maximum relative to the baseline absorbance value at the frequency. The linear correlation between hexanoic acid concentration and the absorbance at 1713 $cm^{-1}$ is shown in FIG. 2.

Example 2

Figure 3:
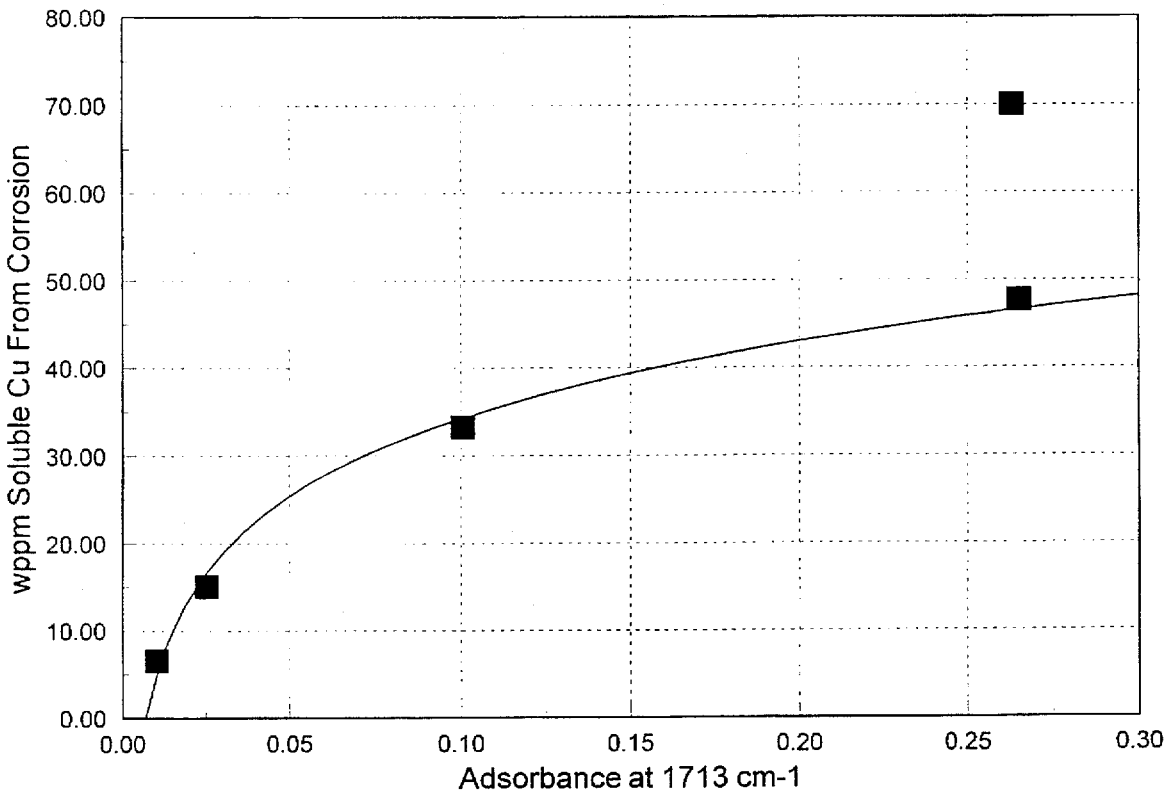
FIG. 3 shows solubilized copper vs. IR absorbance at 1713 $cm^{-1}$.

The following example demonstrates that monitoring the IR absorbance at 1713 $cm^{-1}$ is useful for predicting the corrosivity of that fuel. Fuel corrosivity was measured using the standard Cu Strip corrosion test ASTM D130 with the following modifications: 1) The Cu strip was weighed both before and after the experiment to detect any weight loss from the coupon due to corrosion; 2) ICP analysis was performed on the used fuel after the test to detect dissolved (corroded) Cu in solution 3) The test was run at 100° C. for 3 hours instead of 50° C. The amount of Cu corroded into solution is plotted vs. the infrared absorbance at 1713 $cm^{-1}$. One can clearly see that the absorbance 1713 $cm^{-1}$ is exceedingly sensitive for predicting the onset of corrosion. The process should be adjusted to assure final product absorbance at 1713 $cm^{-1}$ of less than 0.05 AU, assuming a 1 mn optical pathlength cell is used. FIG. 3 shows solubilized copper vs. IR absorbance at 1713 $cm^{-1}$.

Example 3

Figure 4:
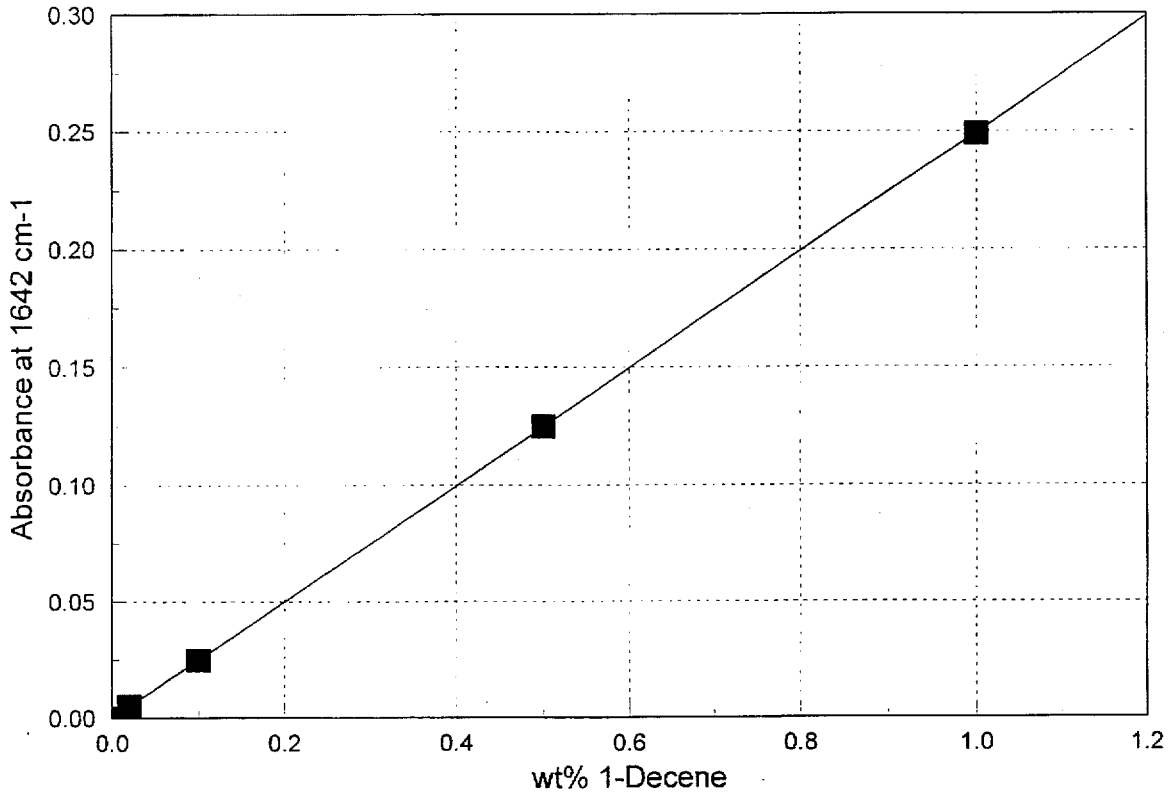
FIG. 4 shows he linear correlation between 1-decene concentration and the absorbance at 1642 $cm^{-1}$.

A hydroisomerized Fischer-Tropsch diesel fuel, nominally boiling from 250–700° F. was spiked successively with 0.02, 0.1, 0.5, and 1 wt % 1-decene. The mid-infrared spectra were measured using a 1 mm pathlength cell and 2 $cm^{31\ 1}$ spectral resolution. A linear baseline correction, drawn between 1658 $cm^{-1}$ and 1630 $cm^{-1}$, was used. (Other cell pathlengths, spectral resolutions, and baseline corrections could be used.) The peak absorbance was taken to be the highest absorbance value in the 1640–1644 $cm^{-1}$ range. The absorbance value reported was determined by measuring the absorbance at the peak maximum relative to the baseline absorbance value at that frequency. The linear correlation between 1-decene concentration and the absorbance at 1642 $cm^{-1}$ is shown in FIG. 4.

Example 4

Figure 5:
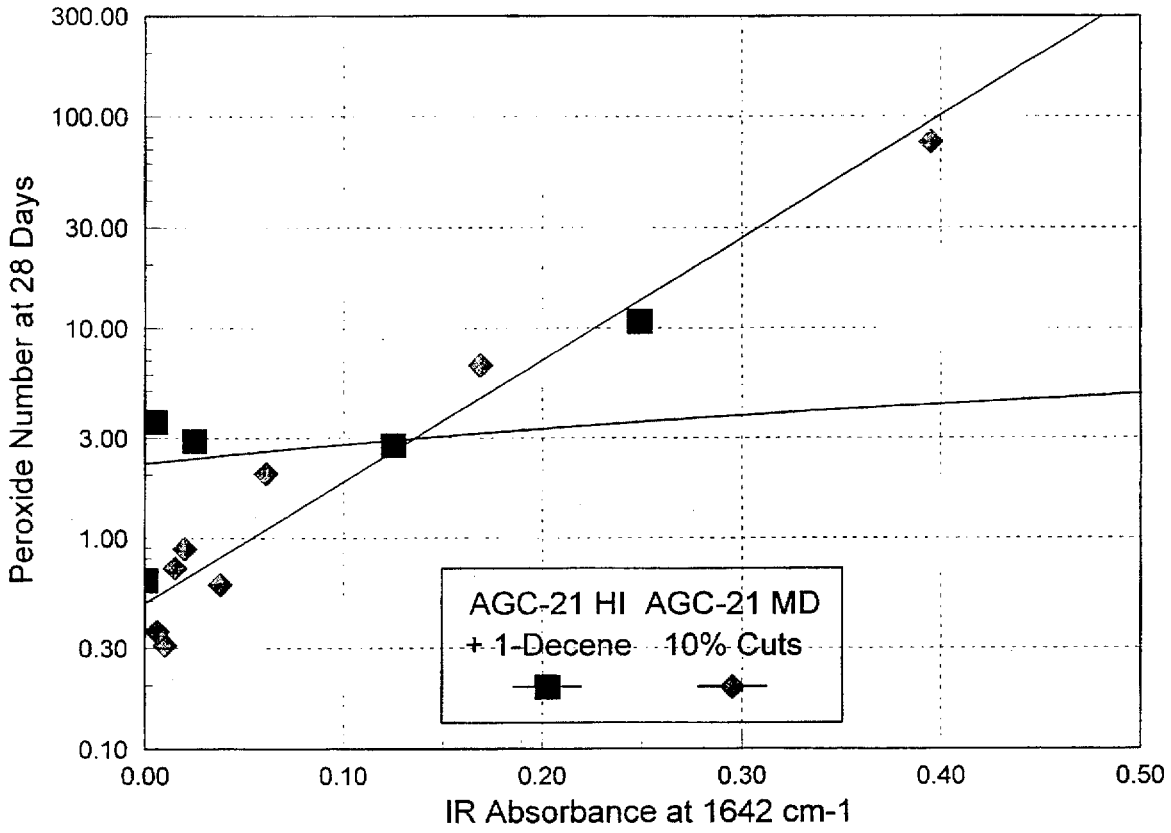
FIG. 5 shows the peroxide number after 28 days as a function of fuel absorbance at 1642 $cm^{-1}$.

Stability of F-T fuels were measured as a function of IR absorbance at 1642 $cm^{-1}$. The stability of F-T fuels was tested by the ASTM D3703 test for Peroxide number. A 100 ml sample of fuel was aerated for 3 minutes after filtering, placed in a 4 oz bottle, and put in an oven at 65° C. Peroxide numbers were measured initially, and then after 7, 14, 21 and 28 days. A result of less than 1 after 28 days is generally considered to be a stable fuel. The peroxide number after 28 days is plotted vs. fuel absorbance at 1642 $cm^{-1}$ in FIG. 5. In general, peroxide numbers greater than 1.00 after 28 days are considered failures. IR absorbance of the final product must clearly be maintained below 0.05 a.u., assuming a 1 mm optical pathlength cell is used.

What is claimed is:

1. A method for controlling a process for producing a distillate fuel heavier than gasoline comprising:

(a) separating the product of a Fischer-Tropsch process into a heavier fraction and a lighter fraction, (b) further separating the lighter fractions using a temperature separator into at least two fractions, (i) at least one fraction including alcohols and (ii) at least one fraction including olefins and acids, (c) irradiating said fraction (i) with IR radiation, (d) measuring the absorption spectrum of said IR radiation, (e) determining a number representative of the concentrations of at least one of alcohols, olefins and acids in said fraction (i), (f) adjusting said temperature of said separator in response to said concentrations to change said concentrations to predetermined values, (g) hydroisomerizing at least a portion of the heavier fractions (a) and at least a portion of the (b) (ii) fractions at hydroisomerization conditions and recovering the hydroisomerization product, and (h) blending at least a portion of the fraction of (b) (i) with at least at portion of the hydroisomerization product.

2. The method of claim 1 wherein said IR spectrum includes the wavenumbers 1642 $cm^{-1}$ and 1713 $cm^{-1}$.

3. The method of claim 1 wherein said IR spectrum includes the wavenumbers 3643 $cm^{-1}$.

4. A method for controlling a process for producing a distillate fuel heavier than gasoline comprising:

(a) separating the product of a Fischer-Tropsch process into a heavier fraction and a lighter fraction, (b) further separating the lighter fractions using a temperature separator into at least two fractions, (i) at least one fraction containing alcohols and (ii) at least one fraction containing olefins and acids, (c) hydroisomerizing at least a portion of the heavier fractions (a) and at least a portion of the (b) (ii) fractions at hydroisomerization conditions and recovering the hydroisomerization product, (d) blending at least a portion of the fraction of (b) (i) with at least a portion of the hydroisomerization product to produce a blended stream, (e) irradiating said blended stream of (d) with IR radiation, (f) measuring the absorption spectrum of said IR radiation, (g) determining a number representative of at least one of the concentrations of said alcohols, olefins, and said acids, and (h) adjusting said temperature of said separator in response to said concentrations to change said concentrations to pre-determined values.

5. The method of claim 4 wherein said IR spectrum includes the wavenumbers 1642 $cm^{-1}$ and 1713 $cm^{-1}$.

6. The method of claim 4 wherein said IR spectrum includes the wavenumbers 3643 $cm^{-1}$.

7. A method for controlling a process for producing a distillate fuel heavier than gasoline comprising:

(a) separating the product of a Fischer-Tropsch process into a heavier fraction and a lighter fraction, (b) further separating the lighter fractions using a temperature separator into at least two fractions, (i) at least one fraction including alcohols and (ii) at least one fraction including olefins and acids, (c) hydroisomerizing at least a portion of the heavier fractions (a) and at least a portion of the (b) (ii) fractions at hydroisomerization conditions and recovering the hydroisomerization product, (d) blending at least a portion of the fraction of (b) (i) with at least a portion of the hydroisomerization product to produce a blended stream, (e) fractionating said blended stream and recovering a distillate product, (f) irradiating said distillate product with IR radiation, (g) measuring the absorption spectrum of said IR radiation, (h) determining a number representative of the concentrations of at least one of alcohols, olefins, and acids in said distillate product, and (i) adjusting said temperature of said separator in response to said concentrations to change said concentrations to pre-determined values.

8. The method of claim 7 wherein said IR spectrum includes the wavenumbers 3643 $cm^{-1}$.

9. The method of claim 7 wherein said IR spectrum includes the wavenumbers 1642 $cm^{-1}$ and 1713 $cm^{-1}$.

* * * * *